United States Patent [19]

Jones

[11] 4,114,873

[45] Sep. 19, 1978

[54] SKATE EXERCISE DEVICE

[76] Inventor: William C. Jones, 902 - 26th Ave. North, St. Cloud, Minn. 56301

[21] Appl. No.: 713,150

[22] Filed: Aug. 10, 1976

[51] Int. Cl.[2] ..... A63B 3/00; A63B 23/02

[52] U.S. Cl. ..... 272/61; 272/63; 272/127

[58] Field of Search ..... 272/70, 62, 63, 127, 272/61; 280/11.19, 11.27, 11.1 R

[56] References Cited

U.S. PATENT DOCUMENTS

| | | | |
|---|---|---|---|
| 1,366,155 | 1/1921 | Bardwell et al. | 272/62 |
| 1,503,550 | 8/1924 | Nelson et al. | 273/63 |
| 2,812,010 | 11/1957 | Abdallah | 272/70 |
| 2,944,815 | 7/1960 | Moyer | 272/62 |
| 3,207,511 | 9/1965 | Hoffman | 272/63 |
| 3,218,068 | 11/1965 | Warman | 272/62 |
| 3,570,477 | 3/1971 | Scrivner | 272/63 |
| 3,871,672 | 3/1975 | Bardy | 272/70 |
| 3,948,513 | 4/1976 | Pfotenhauer | 272/62 |

FOREIGN PATENT DOCUMENTS

| | | | |
|---|---|---|---|
| 834,345 | 1938 | France | 280/11.1 BT |
| 1,117,013 | 1961 | Fed. Rep. of Germany | 280/11.19 |
| 319,819 | 1934 | Italy | 272/63 |

*Primary Examiner*—Richard C. Pinkham
*Assistant Examiner*—Lawrence E. Anderson
*Attorney, Agent, or Firm*—Charles A. Johnson

[57] ABSTRACT

An exercise device having a pair of vertically adjustable hand-hold members, each supported by one of a pair of spaced apart support frames, and a vertically adjustable overhead hand-hold member supported by a transverse support frame, all for use by a person having skates attached to the feet for exercising various parts of the body by twisting and stretching various parts of the body by moving the legs in various back and forth or arcing motions. The skates each include a platform for supporting a foot, harness straps for holding the toes on the support platform while allowing the heel to raise and lower as the legs are moved, and roller elements for allowing the skate to be moved in any direction.

8 Claims, 6 Drawing Figures

SKATE EXERCISE DEVICE

BACKGROUND OF THE INVENTION

1. Field Of The Invention

This invention relates generally to exercise devices utilizing vertically adjustable hand-hold members that can be grasped by a person having skates attached to the feet so that the person can twist and stretch various portions of the body by moving the legs back and forth in sweeping arcs, or the person can simply exercise the legs by moving them forward and backward in a straight line in a walking type manner while maintaining balance by grasping the hand-hold members.

2. Description Of The Prior Art

Various types of exercise structures have been developed in the prior art, those exercisers primarily aimed at assisting hospital patients or geriatric patients in moderate exercise that would relate primarily to walking, and those types of exercise apparatus that would be utilized as physical therapy aids for patients that have been injured, paralyzed, or otherwise disabled from illness, in retraining and strengthening leg muscles in walking motion. These prior art devices generally do not contemplate strenuous exercise of the entire body or any selected portions thereof, and often include complex and expensive apparatus such as turntables, body support harnesses, and the like. These prior art exercise devices are generally of a relatively rigid and fixed construction and not easily disassembled for storage. Various types of roller skates and wheeled devices for attaching to the feet have been developed for recreation and exercise. These prior art wheeled devices have uniformly been of a nature that the foot is firmly restrained on the support platform, since it was contemplated that the foot would lift the wheeled mechanism or would otherwise have to be restrained on the platform to provide control. The prior art skates and wheeled devices normally have the wheels in a fixed relationship one to the other, or at most provide for one set of wheels to be steerable. such configurations are inadequate to allow the wearer to move the skate in sideways or continuous arcing motions, thereby restricting the motion to essentially a single direction, or a back and forth motion without lifting the skate off from the surface.

SUMMARY

In general, there is provided a base member for resting on a hard surface, and arranged for supporting a pair of vertically adjustable hand-hold members, by a pair of spaced apart support frames mounted to the base member, together with a vertically adjustable overhead hand-hold member supported by a transverse support frame mounted to the base member, and so arranged to be used by a person having skates attached to the feet for exercising various parts of the body by moving the legs in various back and forth or continuous arcing motions, where the skates are adapted to hold the ball of the foot on a support while permitting the heel of the foot to raise from the support and the roller elements are independently rotatably mounted to the skate support, thereby permitting the support to be moved in any direction without lifting the skate from the surface. The base member is of a dimension and configuration to permit the full side extention of the legs and the full front and back extention of the legs of an adult, and the support frames are of a sufficient strength to support the entire weight of an adult user. The base member is also adjustable to permit the adjustment of the spacing of the pair of spaced apart support frames.

In view of the foregoing, it is a primary object of this invention to provide an improved exercise device. Still a further object of this invention is to provide an improved exercise device that utilizes a framework that permits the user to support himself by various hand-hold members. Still another object of this invention is to provide an improved exercise device having a framework whereby the user can support himself by various handholds while moving the legs in any direction on skates attached to the seat. Yet another object of this invention is to provide an improved roller skate having the ability to move in any direction without lifting the skate from the surface, for use in conjunction with an exercise support frame. Other objects will become apparent from the following detailed description of the preferred embodiments when considered in conjunction with the drawings.

BRIEF DESCRIPTION OF THE DRAWINGS

The foregoing and other more detailed and specific objectives will be disclosed in the course of the following specification and claims, with reference being made to the accompanying drawings in which:

DESCRIPTION OF THE PREFERRED EMBODIMENT

Figure 1:
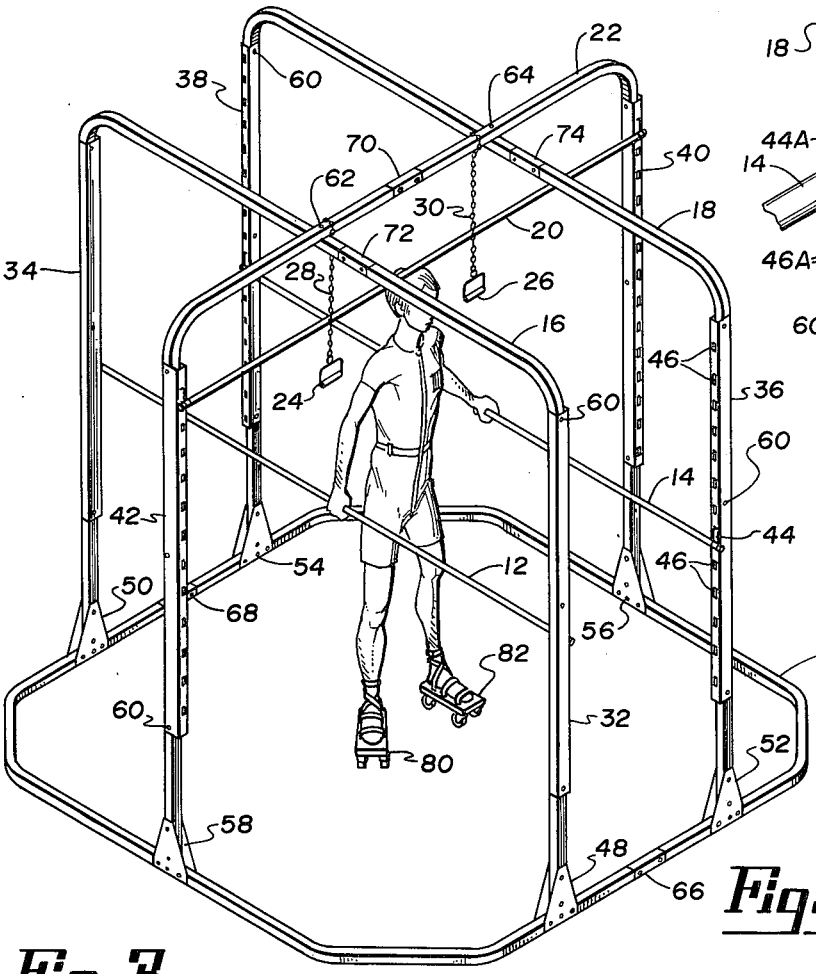
FIG. 1 is a perspective view showing an exercise device, according to the invention.

Referring to the drawings and the numerals of reference thereon, where like parts in the various drawings will be identified by like reference numberals, the following descriptive material will describe the preferred embodiment of the invention.

FIG. 1 is a perspective view of the exercise device of this invention, and has a base member 10 resting on a flat hard surface, such as a concrete or tile floor. As shown, base member 10 is essentially octagonal in shape, but could be configured to be circular, square, rectangular, and the choice of the shape shown is dictated primarily from a consideration of manufacturing economy in forming the members. A pair of hand-hold members 12 and 14 are each supported by an associated one of a pair of spaced apart support frames 16 and 18.

An overhead hand-hold member 20 is supported by transverse support frame 22, and transverse support frame 22 also supports a pair of hand-grips 24 and 26 by chains 28 and 30, respectively. The support frame 16 has vertical sections 32 and 34 for cooperating with the ends of hand-hold member 12 for permitting vertical adjustment of hand-hold member 12. Support frame 18 has vertical members 36 and 38 for cooperating with the ends of hand-hold member 14 for similarly permitting vertical adjustment of hand-hold member 14. Transverse support frame 22 has vertical members 40 and 42 for cooperating with the ends of overhead hand-hold member 20 for permitting the vertical adjustment of hand-hold member 20.

Figure 2A:
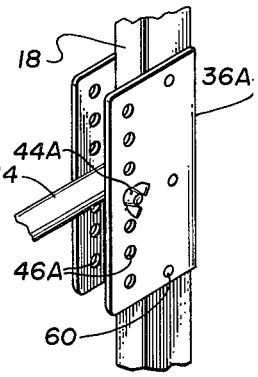
FIG. 2A is an enlarged sectional perspective view of an alternative embodiment of a portion of one of the hand-hold members together with an alternative embodiment of a portion of one of the vertical support members illustrating the mechanism for providing an alternative vertical adjustment of the hand-hold member.
Figure 2:
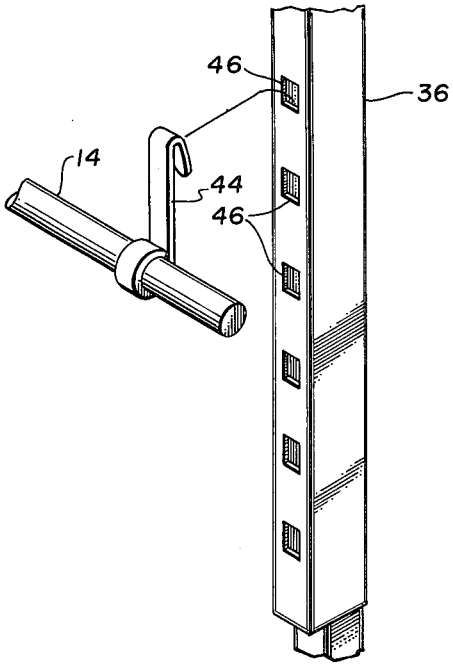
FIG. 2 is an enlarged sectional perspective view of a portion of one of the hand-hold members together with a portion of one of the verticle support members illustrating the mechanism for providing the vertical adjustment of the hand-hold member.

A consideration of FIG. 2 which is an enlarged perspective view of a portion of hand-hold member 14 and vertical support member 36, it can be seen that the end of hand-hold member 14 has a hook member 44 affixed thereto, for use in cooperation with apertures 46 in member 36, with apertures 46 being spaced along the length of member 36. Each end of each hand-hold member 12, 14, and 20 is similarly arranged with a like hook member for cooperation with apertures in the respectively associated one of the vertical members 32, 34, 36, 38, 40, and 42.

Returning to a consideration of FIG. 2A, which is an enlarged sectional perspective view of an alternative embodiment of a portion of one of the hand-hold members together with an alternative embodiment of a portion of one of the vertical support members, and illustrates an alternative mechanism for providing the vertical adjustment of the hand-hold member 14. In this alternative embodiment, upright member 36 is replaced with parallel plates 36A, each affixed to opposite sides of the downward extension of support frame 18 by fastening devices 60. The hook member 44, shown in FIG. 2, is not utilized, and the end of hand-hold member 14 between plates 46A has a hole drilled therethrough. Each of the plates 36A are formed to have a plurality of aligned apertures 46A. A bolt or pin 44A is arranged for holding the end of hand-hold member 14 between plates 36A in a selected one of the vertical positions. This alternative embodiment provides a more rigid mounting for the hand-hold members, and does not permit the hand-hold members to become disengaged during active use of the exercise device.

Returning to a consideration of FIG. 1, support frame 16 is mounted to base 10 by brackets 48 and 50, and support frame 18 is mounted to base 10 by brackets 52 and 54. Support frame 22 is mounted to base 10 by brackets 56 and 58. The brackets are affixed to base 10 by bolts or screws or equivalent fastening devices.

The materials for the exercise device are selected of a type and dimension to provide adequate rigidity to support an adult.

The upright members 32, 34, 36, 38, 40, and 42 comprise channel structures, and are held in place by fasteners 60, which can be bolts, screws, or other appropriate fastening devices.

In order to provide additional strength and rigidity of the exercise device, transverse support frame 22 is fastened to support frames 16 and 18 by bolts 62 and 64.

Couplings 66 and 68 provide for holding base 10 together, and for adjustability of the width dimension of base 10. To accommodate the width adjustment, coupling 70 is utilized to adjust the width of transverse support frame 20. Couplings 72 and 74 are utilized with support frames 16 and 18, respectively. The person utilizing the exercise device has skates 80 and 82 affixed to the feet, and by supporting himself with holding on to hand-hold members 12 and 14, or overhead hand-hold member 20 or by holding onto hand-grip members 24 and 26, or any combination thereof, can exercise various muscles and portions of the body by moving skates 80 and 82 in a back and forth walking motion, or transversely to the body in a back and forth motion, or in arcing motions whereby the body is twisted and stretched from torso through the hips. The adjustment of the height of the hand-hold members 12 and 14 provides a different level of balance, and will be adjusted according to the type of exercise being accomplished.

Figure 3:
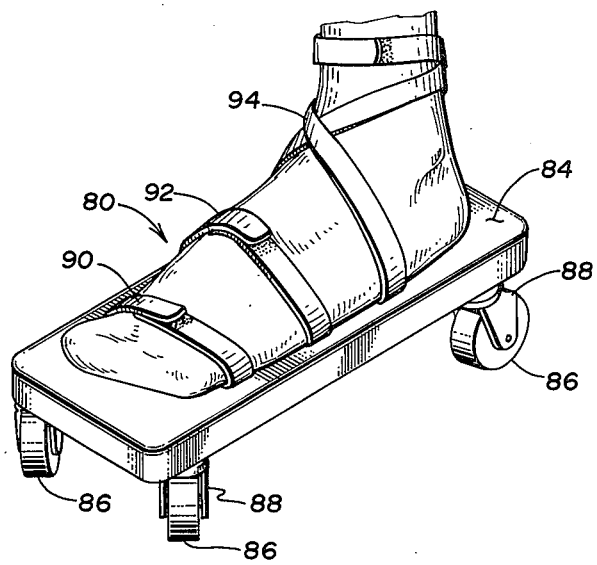
FIG. 3 is a perspective view of one of the skate units for use with the exercise device, showing a foot held in place.

With reference to FIG. 3, there is shown a perspective view of one of the skate devices referenced generally by reference numeral 80. The skate 80 has a foot support or tread surface 84, and a plurality of rollers 86 affixed to the under side of the skate tread 84. The support of the rollers 86 are respectively by rotatable couplings 88, it being understood that the rotatable couplings 88 are rotatable around an axis perpendicular to the tread surface 84. Straps 90 and 92 are adapted for holding the toes and the ball of the foot on the tread surface 84, and are of a type of material that are self-adhering and adjustable to the size of the foot of the user. It should be understood that buckles, laces, or a foot enclosure such as a partial shoe could also be utilized. An ankle strap 94 is arranged for holding the ankle secure, while allowing it to be raised from the tread surface 84, such as would be accomplished by a binding such as is used for cross-country skiing, or on snowshoes, or the like.

Figure 4:
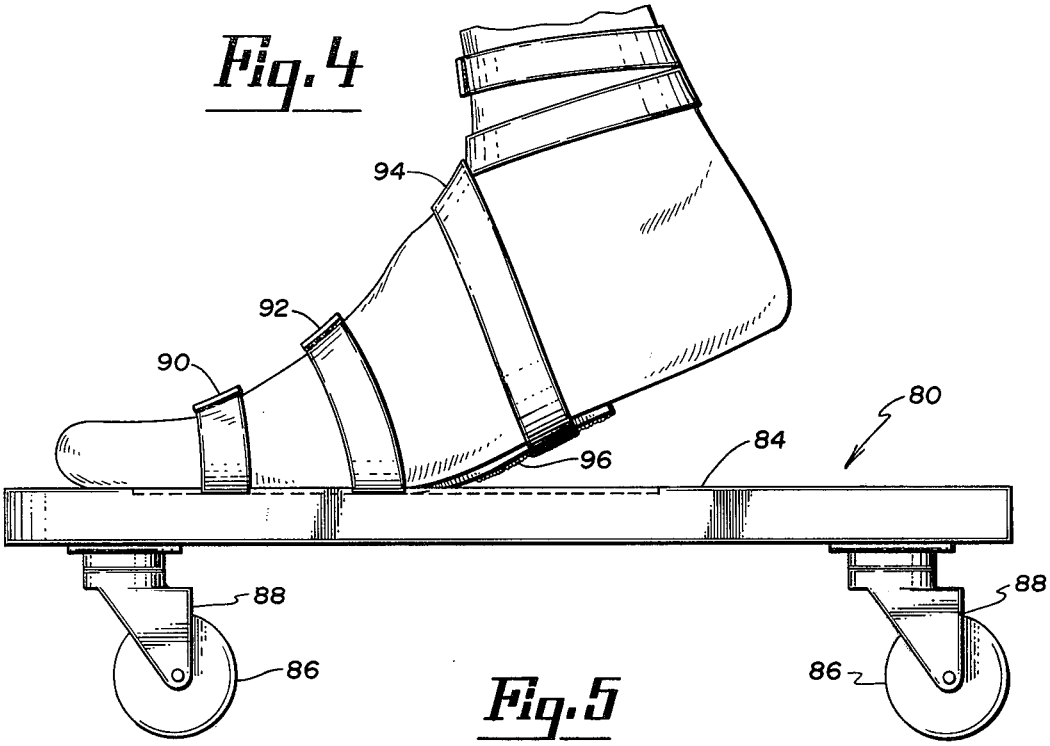
FIG. 4 is a side elevation view of the skate utilized with the exercise device, illustrating the toes and ball of the foot restrained on the tread of the skate device with the heel of the foot being raised from the surface of the tread of the skate.

FIG. 4 is a side elevation view of the skate 80 shown in FIG. 3, and illustrates that the toe of the foot and the ball of the foot are restrained by straps 90 and 92, and that web member 96 passes under the arch of the foot and is held in place by strap 94 which encircles the foot and encircles the ankle. The tread portion of the skate 84 receives the web 96, and inhibits sideways or angular slipping of the foot.

The casters 86 are of a durable material such as wood, plastic, hard rubber, or the like, it being understood that a durable material is desired and one that will not mark or mar a tile or other hard surface upon which it would be used. The caster frames 88 are mounted to the underside of the skate 80, and are all free to rotate completely. The weight of the person utilizing this skate on the skate provides a resistance to a change of motion due to the friction in the bearings of the caster housings 88, the details of which are not illustrated, and it is this resistance to change of direction required by the rotation of the housings 88 that causes the amount of exertion that is needed to change direction of motion of the feet and legs of the user.

Figure 5:
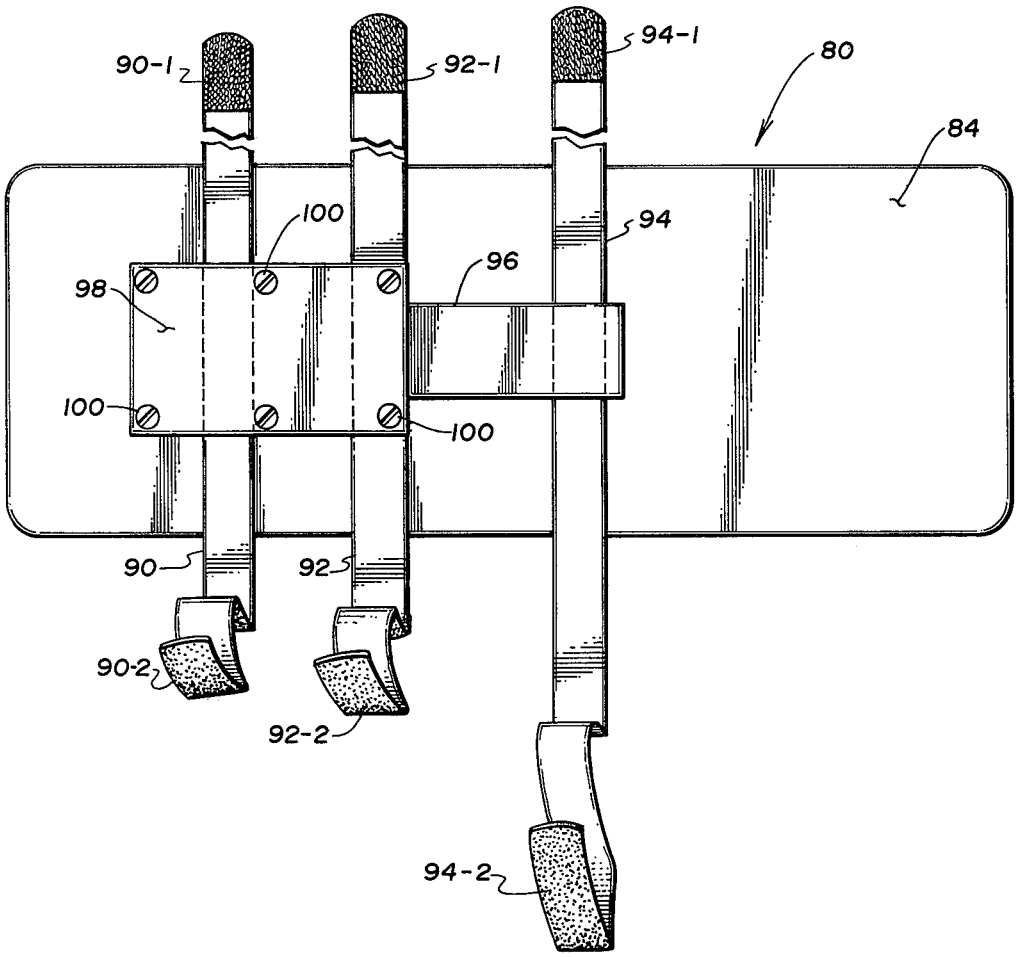
FIG. 5 is a top view of the skate utilized with the exercise device.

FIG. 5 is a top view of the skate 80, and illustrates that the tread surface 84 has a pad 98 affixed to the tread surface 84 such as by screws 100, whereby pad 98 restrains straps 90 and 92 in place. Web 96 is affixed to pad 98, and is flexible and provides for holding strap 94 in a position such that it can be wrapped around the foot and ankle as previously described. In this embodiment, the straps 90, 92, and 94 have end portions 90-1 and 90-2, 92-1 and 92-2, and 94-1 and 94-2, respectively, comprised of self-adhering material that renders the size adjustable. As mentioned, these ends could be fitted with buckles, snaps, laces, or other well-known fastening devices, or the straps could be replaced by an actual shoe having the sole portion under the toe and ball of the foot affixed to tread 84.

For proper operation of the skate in conjunction with the exercise device, it is essential that the heel of the user be free to raise and lower off from the tread surface 84 in a normal walking motion.

An alternate embodiment of the skate which is not illustrated, could utilize roller bearings in place of the rotatable casters, without departing from the spirit and scope of the invention.

A consideration of the foregoing detailed description of a preferred embodiment indicates that the stated objectives of the invention have been achieved. It being recognized that various modifications of dimensions, physical arrangement, and selection of materials, will become apparent to those skilled in the art, without departing from the spirit and scope of this invention, what is intended to be protected by Letters Patent is set forth in the appended claims.

What is claimed is:

1. An exercise device comprising first and second spaced-apart support frame means; first and second hand-hold means for supporting and balancing a person using the exercise device; first vertical adjustment means for supporting said first and second hand-hold means on respectively associated ones of said first and second support frame means in predetermined adjustable vertical positions, the selected height adjustment operable to cause exercise of differing muscles of the user; third support frame means arranged transverse to said first and second support frame means; third hand-hold means for supporting and balancing a person using the exercise device; second vertical adjustment means for supporting said third hand-hold means on said third support frame means in predetermined vertical positions above the head of the user; first coupling means for coupling said first and second spaced apart support frame means to said third support frame means for providing structural rigidity; a base member including at least first and second side means for supporting associated parts of said first and second spaced-apart support frame means and said third support frame means, said base member arranged for permitting unrestricted extension of the legs of the user in all directions; second coupling means for coupling said first, second and third support frame means to said base member for providing structural rigidity; and a pair of skate means for supporting the feet of a person using the exercise device, each of said skate means including rotatable means for permitting said skate means to be moved in any direction on the supporting surface without lifting said skate means out of contact with said surface, and permitting the user to move the legs in any direction for exercising various parts of the body depending upon the motion of the legs and the level of vertical adjustment of said first and second vertical adjustment means; first adjustable coupling means in cooperation with said base member and second adjustable coupling means in cooperation with said third support frame means, said first and second adjustable coupling means for adjusting and determining the distance between said first and second spaced-apart support frame means for adjusting to the arm span of the user.

2. An exercise device as in claim 1 wherein said first vertical adjustment means includes hook means on each end of said first and second hand-hold means; and a plurality of upright means, each mounted on an associated one of said first and second spaced-apart support frame means and each having a plurality of vertically spaced-apart apertures for receiving and retaining associated ones of said hook means; said second vertical adjustment means includes second hook means on each end of said third hand-hold means; and a pair of upright means mounted on said third support frame means and each having a plurality of vertically spaced-apart apertures for receiving and retaining associated ones of said second hook means.

3. An exercise device as in claim 1 and further including a pair of hand-grip means; chain means for coupling said pair of hand-grip means to said third support frame means.

4. An exercise device as in claim 1 wherein said first and second vertical adjustment means includes a transverse hole at each end of said first, second and third hand-hold means; a plurality of pairs of spaced-apart plate means, each of said pairs mounted on respective ones of said first, second and third support means for cooperation with a respectively associated end of one of said first, second, and third hand-hold means, and each of said plate means having a plurality of vertically spaced-apart aligned apertures; and a plurality of pin means, each for passing through an associated pair of apertures in an associated one of said plurality of pairs of spaced-apart plate means and an associated one of said transverse holes for holding the end of said hand-hold means between said plate means in a predetermined vertical position.

5. An exercise device as in claim 1 wherein each of said pair of skate means includes platform means for supporting a foot of the user, harness means coupled to said platform means for restraining the toe portion of the foot of the user while allowing the heel of the foot to raise and lower, and roller means for allowing movement in any direction without lifting the skate from the surface.

6. An exercise device as in claim 5 wherin said roller means includes a plurality of rotatable coupling means mounted to said platform means, and each rotatable around an axis perpendicular to said platform means.

7. An exercise device as in claim 6 wherein each of said plurality of rotatable coupling means includes a rotatable caster wheel.

8. An exercise device as in claim 7 wherein said harness means includes web means coupled to said platform means, toe strap means for holding the toes of the user firmly on said web means, an ankle strap means for holding the ankle secure while allowing the heel to be raised and lowered with relation to said platform means.

* * * * *